US005864988A

United States Patent [19]

Frederick, Jr.

[11] Patent Number: 5,864,988

[45] Date of Patent: Feb. 2, 1999

[54] DOUBLE EGRESS DOOR AND FRAME UNIT

[75] Inventor: Claud Frederick, Jr., Cincinnati, Ohio

[73] Assignee: Ingersoll-Rand Company, Woodcliff Lake, N.J.

[21] Appl. No.: 919,017

[22] Filed: Aug. 27, 1997

[51] Int. Cl.[6] ..... E06B 1/04

[52] U.S. Cl. ..... 49/504; 49/371

[58] Field of Search ..... 49/104, 142, 371, 49/381, 399, 504, 366, 367, 368, 369, 116; 16/389, 390, 391, 392; 160/371, 117, 118, 119

[56] References Cited

U.S. PATENT DOCUMENTS 2,975,830 3/1961 McDonald ..... 16/592 X
5,581,940 12/1996 Peterson ..... 49/371 X

FOREIGN PATENT DOCUMENTS 546912 10/1959 Belgium ..... 16/396
1156333 10/1963 Germany ..... 16/390

*Primary Examiner*—Jerry Redman
*Attorney, Agent, or Firm*—Michael H. Minns

[57] ABSTRACT

A double egress frame and door unit comprising: a first jamb having a first jamb stop thereon and having a soffit adjacent the stop; a second jamb having a second jamb stop thereon and having a soffit adjacent the stop; a first door swinging in a first direction and being connected to the first jamb by hinges; a second door swinging in a second direction opposite to the first direction and being connected to the second jamb by hinges; a header connected to an upper end of the first and second jambs, the header having first and second header stops thereon, the first header stop being coplanar with the first jamb stop, the second header stop being coplanar with the second jamb stop; and the hinges connecting the first door to the first jamb and connecting the second door to the second jamb permitting each door to swing clear of the soffit of the jambs when the doors are in an open position.

14 Claims, 4 Drawing Sheets

DOUBLE EGRESS DOOR AND FRAME UNIT

BACKGROUND OF THE INVENTION

This invention relates generally to doors and door frames and more particularly to double egress doors and door frames.

Double egress frames are designed to separate corridors into fire control sections and to control the traffic flow in the corridor without providing an obstacle. The frame is designed to allow the doors to swing in opposite directions without interference with one another. The doors when closed block the corridor and prohibit the passage of flames from one section to another. The profile of the jambs is a three step shape. The center step is where the door is located.

Although the double egress is used to provide fire separation, the frame can also be used as a strict traffic control device. Since the doors open in opposite direction, traffic is diverted to the right side (left side if required) of the corridor.

The double offset in the frame reduces the corridor opening width. The reduction in the corridor width and subsequent door width violates some building codes that require a minimum clear opening width.

The foregoing illustrates limitations known to exist in present double egress doors and door frames. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a double egress frame and door unit comprising: a first jamb having a first jamb stop thereon and having a soffit adjacent the stop; a second jamb having a second jamb stop thereon and having a soffit adjacent the stop; a first door swinging in a first direction and being connected to the first jamb by hinges; a second door swinging in a second direction opposite to the first direction and being connected to the second jamb by hinges; a header connected to an upper end of the first and second jambs, the header having first and second header stops thereon, the first header stop being coplanar with the first jamb stop, the second header stop being coplanar with the second jamb stop; and the hinges connecting the first door to the first jamb and connecting the second door to the second jamb permitting each door to swing clear of the soffit of the jambs when the doors are in an open position.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

The double egress door frame of the present invention maintains the basic concept of double egress openings but allows standard width doors and hardware preparations to be used. The header does not change. It remains a single rabbeted section that incorporates the stop that prohibits the doors from swinging through the opening.

The double egress door frame of the present invention incorporates single rabbeted jambs instead of the typical stepped profile jambs. By changing to single rabbeted jambs, the opening width will increase and conventional hinge preparations can be used. With the use of "clear swing" hinges, such as Stanley® hinge no. FBB278, the door can move out of the opening into an area that is protected by the jamb (semi-pocket condition). "Clear swing" hinges can not be used with the typical three step profile double egress jambs.

Figure 1:
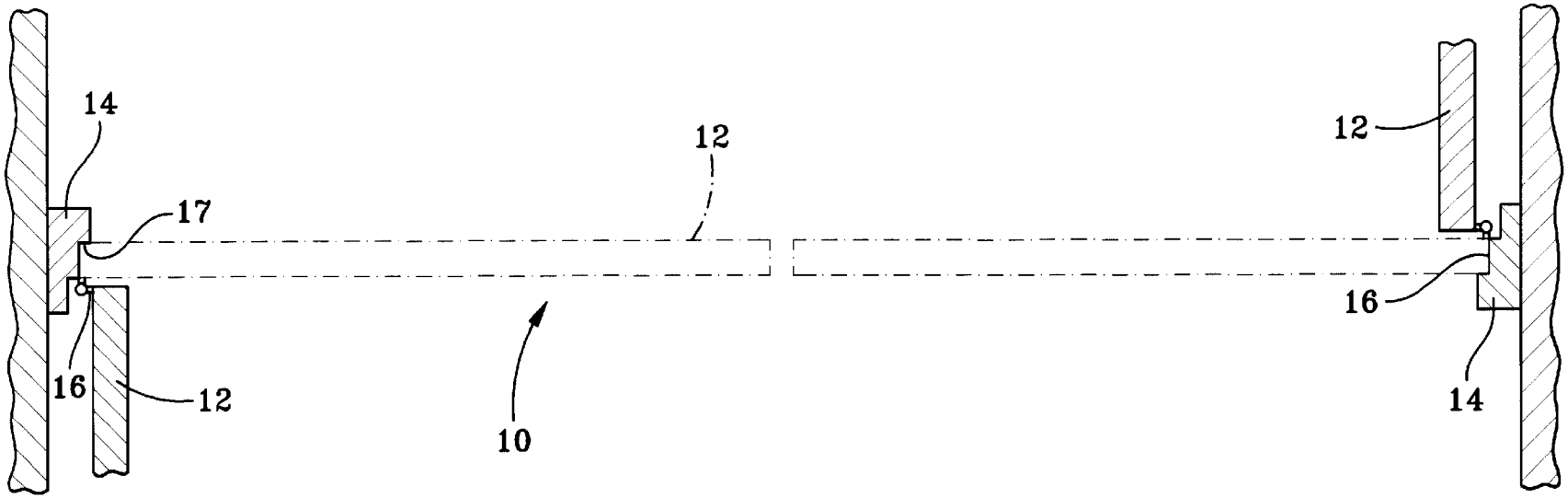
FIG. 1 (PRIOR ART)
FIG. 1 is a cross-sectional view of a typical prior art double egress frame and doors.

FIG. 1 shows a typical prior art double egress door frame and doors 10. The door frame includes two double rabbeted hinge jambs 14 connected by a header (not shown). Each hinge jamb 14 includes two offset areas to permit mounting of hinges 16. This places the doors 12 in the center of the hinge jamb depth. One of the offsets 17 acts as a stop for the door 12 and prohibits the door 12 from moving through the opening and blocks the passage of flames around the hinge side of the opening. As shown in FIG. 1, the double offset in the hinge jambs 14 reduces the corridor opening width. When the doors 12 are open, the doors extend further into the opening in the double egress frame 10 than the hinge jambs 14, further reducing the opening.

Figure 2:
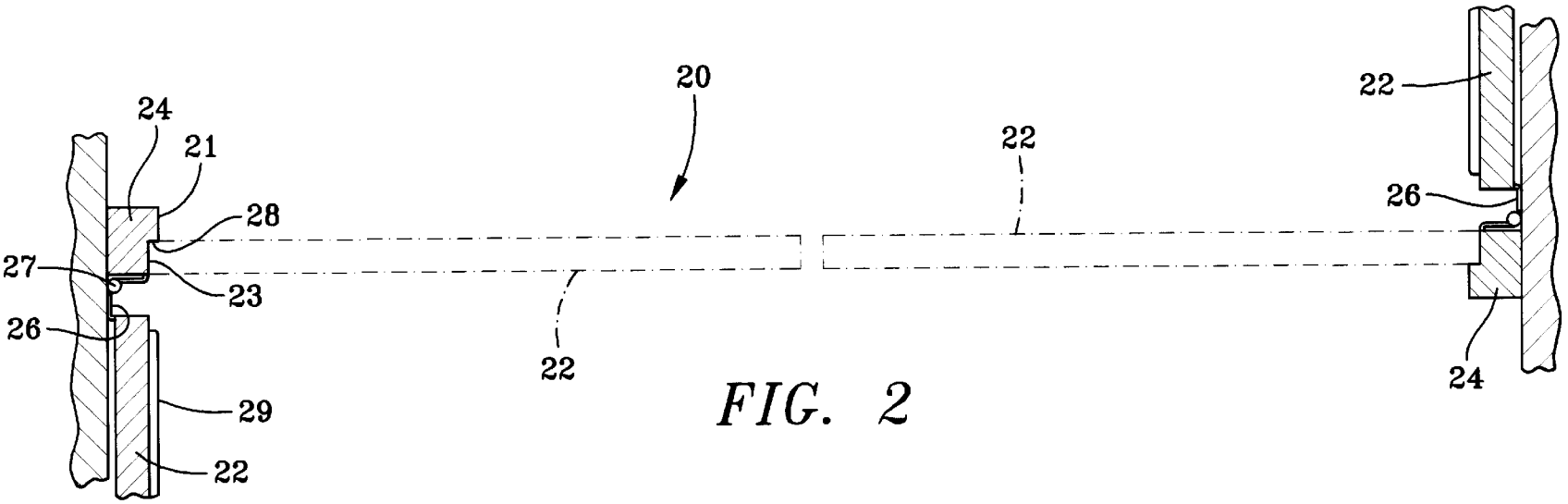
FIG. 2 is a cross-sectional view of one embodiment of a double egress door with a novel frame.
Figure 4:
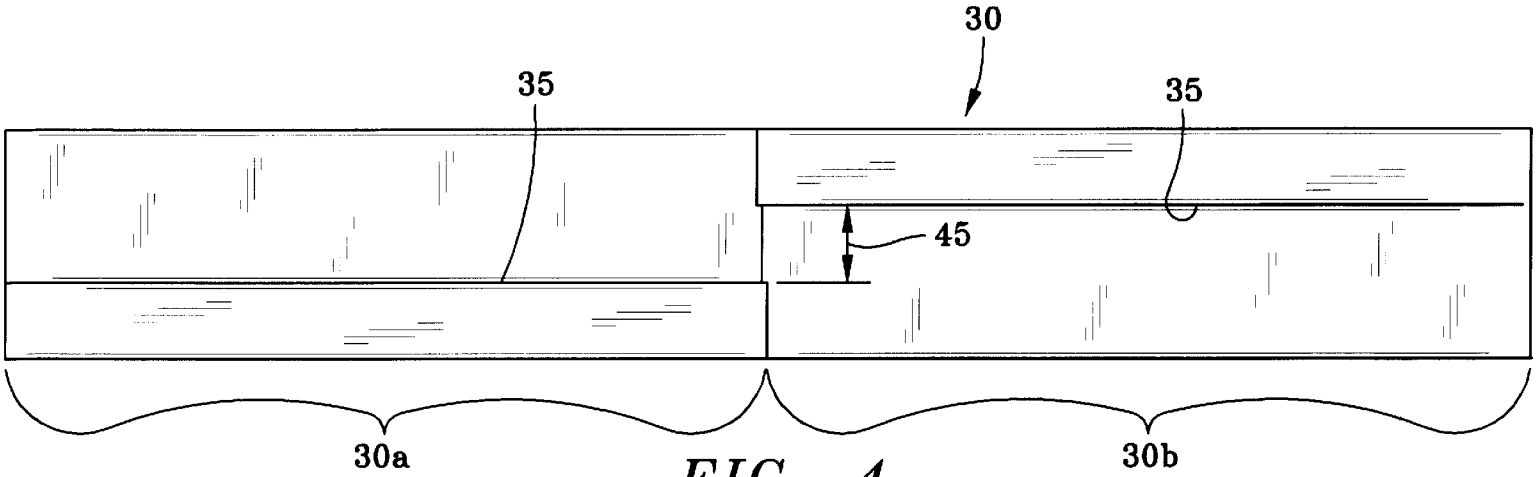
FIG. 4 is a plan view of a head frame for use with the double egress frame and doors shown in FIG. 2.
Figure 4A:
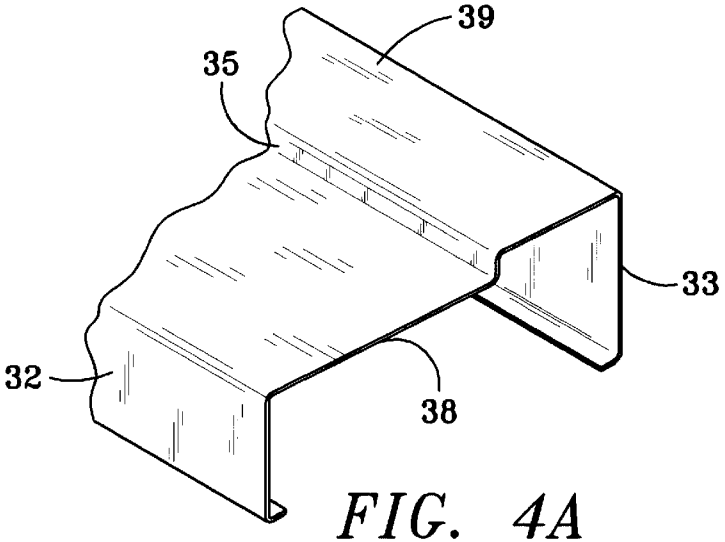
FIG. 4A is a perspective view of the head frame shown in FIG. 4.

FIG. 2 shows the preferred embodiment of the present invention. The double egress frame and doors 20 includes two single rabbet hinge jambs 24 connected by a single rabbet header 30 (shown in FIGS. 4 and 4A). Each hinge jamb includes a door stop 28. Adjacent to and perpendicular to the door stop 28 is a soffit 21. The hinge jambs 24 are installed with the door stops 28 facing one another and offset by approximately the width of the doors 22.

A unique header 30 connects the hinge jambs 24. The header 30 consists of two mirrored sections 30*a,* 30*b*. Each header section 30*a,* 30*b* consist of a single rabbet having vertically oriented front and rear faces 32, 33. The front and rear faces 32, 33 are connected by two horizontally oriented surfaces 38, 39 which are connected by a vertically oriented header stop 35. The two header sections 30*a,* 30*b* are connected to one another with the header stops 35 facing in opposite directions and offset from one another by a distance 45 which is approximately equal to the thickness of the doors 22.

Figure 5:
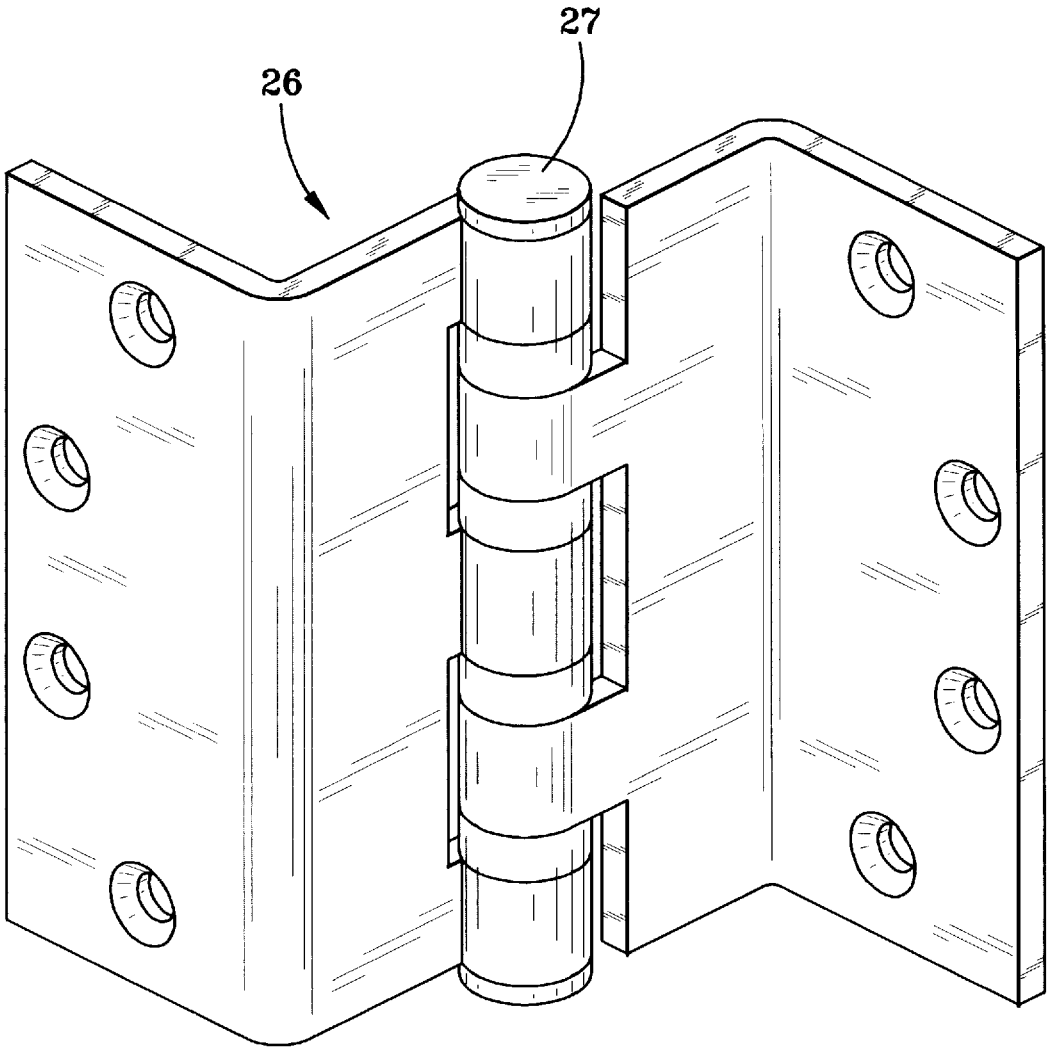
FIG. 5 is a perspective view illustrating a hinge for use with the double egress frame and doors shown in FIGS. 2 and 3.

Preferably, the doors 22 are connected to the hinge jambs 24 by "clear swing" hinges 26, as shown in FIG. 5. The pivot point 27 of the hinges 26 is offset from the rabbet 23 away from the opening between the hinge jambs 24. The use of the single rabbet hinge jambs 24 with offset door stops 28 along with hinges 26 having an offset pivot 27 permits the doors 22 and associated door exit hardware 29 mounted thereon to swing clear of the opening between the hinge jambs 24 (i.e., soffit 21), thereby increasing the maximum opening between hinge jambs for a double egress door frame and door.

Figure 3:
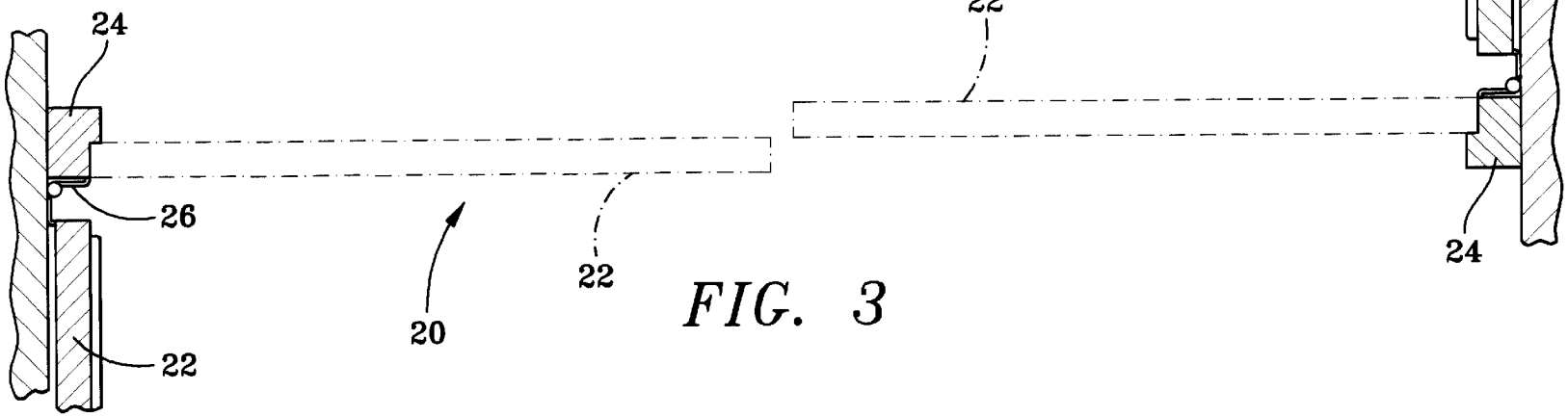
FIG. 3 is a cross-sectional view of a second embodiment of a double egress door with a novel frame.

An alternate embodiment of the double egress door frame and doors 20 is shown in FIG. 3. In this embodiment, single rabbet hinge jambs 24 are used, but the door stops 28 are not offset from another. The door stops 28 in FIG. 3 lie in a common plane. This results in the doors 22 being offset from one another, as shown.

Having described the invention, what is claimed is:

1. A double egress frame and door unit comprising:

a first jamb having a first jamb stop thereon and having a soffit adjacent the stop;

a second jamb having a second jamb stop thereon and having a soffit adjacent the stop;

a first door swinging in a first direction and being connected to the first jamb by hinges;

a second door swinging in a second direction opposite to the first direction and being connected to the second jamb by hinges;

a header connected to an upper end of the first and second jambs, the header having first and second header stops thereon, the first header stop being coplanar with the first jamb stop, the second header stop being coplanar with the second jamb stop; and the hinges connecting the first door to the first jamb and connecting the second door to the second jamb permitting each door to swing clear of the soffit of the jambs when the doors are in an open position.

2. The double egress frame and door unit according to claim 1, wherein the first jamb stop and the second jamb stop are coplanar.

3. The double egress frame and door unit according to claim 1, wherein the first jamb stop is in a first plane, the second jamb stop is in a second plane, the first plane being parallel to and offset relative to the second plane.

4. The double egress frame and door unit according to claim 3, wherein the first plane is offset from the second plane by a distance equal to about a thickness of each door.

5. The double egress frame and door unit according to claim 1, wherein each door has a first face and a second face, each first face being coplanar and each second face being coplanar when the doors are in a closed position.

6. The double egress frame and door unit according to claim 1, wherein the soffit of the first jamb is a first distance from the soffit of the second jamb, the first door having a face in a first plane, the second door having a face in a second plane, when the doors are in an open position, the first door face and the second door face facing towards one another and the first plane being a second distance from the second plane, the second distance being greater than the first distance.

7. The double egress frame and door unit according to claim 1, wherein the first header stop is coplanar with the second header stop.

8. The double egress frame and door unit according to claim 1, wherein the first header stop is offset from the second header stop by a distance equal to about a thickness of each door.

9. The double egress frame and door unit according to claim 1, further comprising:

door exit hardware attached to each door, the door exit hardware clearing the soffit when the doors are in an open position.

10. The double egress frame and door unit according to claim 1, wherein each hinge comprises two hinge leaves connected by a pivot pin, the pivot pin being offset from the soffit in a direction away from an opening formed between the first and second jambs.

11. A double egress frame and door unit comprising:

a first jamb having a first jamb stop thereon and having a soffit adjacent the stop;

a second jamb having a second jamb stop thereon and having a soffit adjacent the stop;

a first door swinging in a first direction being connected to the first jamb by hinges;

a second door swinging in a second direction opposite to the first direction being connected to the second jamb by hinges;

a header connected to an upper end of the first and second jambs, the header having first and second header stops thereon, the first header stop being coplanar with the first jamb stop, the second header stop being coplanar with the second jamb stop; and the hinges connecting the first door to the first jamb and connecting the second door to the second jamb including a means for permitting a planar surface of each door to swing clear of the soffit of the jambs when the doors are in an open position.

12. The double egress frame and door unit according to claim 11, wherein each hinge comprises two hinge leaves connected by a pivot pin, the pivot pin being offset from the soffit in a direction away from an opening formed between the first and second jambs.

13. A double egress frame and door unit comprising:

a first jamb having a first jamb stop thereon and having a soffit adjacent the stop;

a second jamb having a second jamb stop thereon and having a soffit adjacent the stop;

a first door swinging in a first direction being connected to the first jamb by hinges;

a second door swinging in a second direction opposite to the first direction being connected to the second jamb by hinges;

a header connected to an upper end of the first and second jambs, the header having first and second header stops thereon, the first header stop being coplanar with the first jamb stop, the second header stop being coplanar with the second jamb stop;

door exit hardware attached to each door; and the hinges connecting the first door to the first jamb and connecting the second door to the second jamb including a means for permitting a planar surface of each door and the door exit hardware to swing clear of the soffit of the jambs when the doors are in an open position, wherein the first jamb stop lies in a first plane, the second jamb stop lies in a second plane, the first plane being parallel to and offset from the second plane by a distance equal to about a thickness of each door.

14. The double egress frame and door unit according to claim 13, wherein each hinge comprises two hinge leaves connected by a pivot pin, the pivot pin being offset from the soffit in a direction away from an opening formed between the first and second jambs.

* * * * *